US006783092B1

(12) United States Patent
Robson

(10) Patent No.: US 6,783,092 B1
(45) Date of Patent: Aug. 31, 2004

(54) ROCK CRUSHERS

(75) Inventor: Angus Peter Robson, Matamata (NZ)

(73) Assignee: Rocktec Limited, Matamata (NZ)

( * ) Notice: Subject to any disclaimer, the term of this patent is extended or adjusted under 35 U.S.C. 154(b) by 0 days.

(21) Appl. No.: 09/646,013

(22) PCT Filed: Mar. 12, 1999

(86) PCT No.: PCT/NZ99/00030

§ 371 (c)(1),
(2), (4) Date: Nov. 6, 2000

(87) PCT Pub. No.: WO99/46049

PCT Pub. Date: Sep. 16, 1999

(30) Foreign Application Priority Data

Mar. 13, 1998 (NZ) ..... 329800

(51) Int. Cl.[7] ..... B02C 19/00
(52) U.S. Cl. ..... 241/275; 241/285.3
(58) Field of Search ..... 241/275, 285.2, 241/285.3, 5, 286, 287

(56) References Cited

U.S. PATENT DOCUMENTS 2,012,294 A 8/1935 Wright et al.
2,919,864 A 1/1960 Parmele
3,578,254 A * 5/1971 Wood ..... 241/275
4,017,035 A 4/1977 Stuttmann
5,135,177 A * 8/1992 Okuhara ..... 241/275
5,145,118 A * 9/1992 Canada ..... 241/81
5,292,080 A * 3/1994 Liebing ..... 241/275

FOREIGN PATENT DOCUMENTS

EP 0 562 194 9/1993

* cited by examiner

*Primary Examiner*—Mark Rosenbaum
(74) *Attorney, Agent, or Firm*—Finnegan, Henderson, Farabow, Garrett & Dunner, LLP

(57) ABSTRACT

The invention relates to improvements to rock crushers, and in particular rotary impact rock crushers. The crushing chamber may be angled to achieve the desired rock product. Also disclosed is an anvil for use in crusher whereby the anvil position adjustable. The invention enables the operator to dial up a particular rock product specification by adjusting the angle of the crushing chamber and/or the position of the anvil. The adjustments may be made without ceasing the operation of the machine. Improved control over fracture mechanisms within the crushing chamber and as a consequence the rock product, are achievable with the present invention.

24 Claims, 6 Drawing Sheets

ROCK CRUSHERS

TECHNICAL FIELD

This invention relates to improvements to rock crushers.

In particular, the present invention relates to improvements in rotary) impact rock crushers which provide a greater control over the fracture mechanisms and the grade of rock product.

BACKGROUND ART

The many end use applications for rocks require that a range of rock grades are available for use.

The desirable characteristics of a rock product are that it is shaped and graded to suit the duty for which it is required and the strength of the rock is maximized.

The desirable crushing characteristics of a crusher are that there is a high size reduction of the rock, shape and strength of the rock product are maintained or improved and that the crush can be controlled to maximise the desired end product.

There is generally a large compromise between what a crusher will make and what rock product is required. High reduction generally gives poor shape and low strength rock which are undesirable. Low reduction generally gives good shape and high strength which are desirable but high by-product and low output which arm undesirable.

It is common to create a by-product in order to make a specification rock product. This by-product is expensive to produce, has low commercial value and sometimes high environmental costs.

It can be seen that there will be a balance between these characteristics as to which best suits a) the rock product required; and b) the crusher making it.

The current problem is that specifications for rock products are becoming much tighter.

existing crushers lack the control to make a variety of tight specification products at a high rate or without by-product.

Finishing crushers generally fall into the following categories:

Cone Crushers, where rock is crushed by compression between two eccentric metal cones. These machines have good reduction but do not produce fine sand or have good shape.

Hammermills, where rock is crushed by impact with metal hammers attached to a rotor on a horizontal shaft to metal anvil linings in the crusher casing. These machines have high operating costs and the rock product changes rapidly as the crusher wears, i.e. they will not hold the desired rock product specification.

Anvil VSIs, where rock is thrown by a metal impeller (referred to as a rotor) onto metal lining, and is crushed by impact. These machines have good reduction but high operating costs, lower rock strength, bad shape, and won't hold a desired rock product specification as they wear. Anvil VSIs must also be stopped frequently in order to replace worn anvils, which results in expensive down-time.

Rock on Rook VSIs, where rock is crushed by impact with a rock lined impeller (known as a rotor) on a vertical shaft to rock linings in the crusher casing. These machines have high rock strength good shape and produce good sand but have low reduction, and often produce high by-product (unwanted product).

The main reason for low reduction in the Rock-on-Rock VSI is explained as follows. Rock ejected from the rotor is flung out into the crushing chamber where it strikes the rock bed and circulates in the chamber forming a rock swirl.

Rock on rock crushing occurs when rocks ejected from the rotor impact against rocks in the rock swirl. The greatest impact occurs when there is the greatest possible speed differential between the ejected rocks and the swirling rocks. Generally, the swirl moves rapidly in the same direction as the ejected rock and therefore the motion of the rock swirl particle reduces the impact force between the rock swirl particle and the rock ejected from the rotor.

VSI crushers provide some control over the rate of the rock swirl by variation in speed only (reducing rotor speeds which sacrifices output, and reduction).

Cone and Hammermill crushers only control a specific gap in which rock is crushed which has no control over the rock fracture mechanism.

The Applicant has compiled the following table, subjectively depicting the advantages and disadvantages of each crusher type.

The points given are subjective with the greater number of points, the higher the performance.

TABLE 1

| | Possible Points | Standard Cone | Short/ Fine Cone | Rock on Rock VSI | Anvil VSI | Hammer-mill/ Impactor |
|---|---|---|---|---|---|---|
| Performance | | | | | | |
| Feed Size | 4 | 4 | 1 | 2 | 4 | 3 |
| Dust Production | 4 | 1 | 2 | 3 | 3 | 2 |
| Chip Production | 4 | 3 | 2 | 3 | 4 | 2 |
| Product Shape | 4 | 2 | 2 | 4 | 2 | 3 |
| Product Control | 4 | 2 | 2 | 2 | 2 | 2 |
| Cost | | | | | | |
| Wear Rate | 6 | 6 | 5 | 6 | 1 | 1 |
| Power Consumption | 3 | 3 | 3 | 1 | 2 | 2 |
| Capital Cost | 8 | 1 | 2 | 4 | 2 | 6 |
| Installation | | | | | | |
| Height | 2 | 2 | 2 | 1 | 1 | 2 |
| Weight | 2 | 1 | 1 | 2 | 1 | 2 |
| TOTAL | 41 | 25 | 22 | 28 | 22 | 25 |

Clearly if a crusher could combine the characteristics of one crusher one day to make product 'X', and be changed in a controlled way to provide the characteristics of a different crusher on another day to make product 'Y' this would be a useful advancement of the art.

It is an object of the present invention to address the foregoing problems of at least to provide the public with a useful choice.

Further aspects and advantages of the present invention will become apparent from the ensuing description which is given by way of example only.

DISCLOSURE OF INVENTION

According to one aspect of the present invention there is provided a rotary impact rock crusher having componentry which includes a crushing chamber housing, and a rotor into which rock may be introduced and ejected therefrom positioned in the crushing chamber housing, the rock crusher characterised in that the relative angles of at least one of the crusher components is adjustable with respect to the vertical.

In some embodiments, the present invention may be configured so that the rotor angle and the angle of the crushing chamber housing with respect to the vertical are adjustable independently of each other.

In some embodiments, the rotor angle may be varied relative to the crushing chamber without departing from the scope of the present invention.

In preferred embodiments, the present invention may be configured so that the planes of the rotor and the crushing chamber housing are at a fixed relative position to each other so the rotor and crushing chamber housing are moveable together with respect to the vertical Reference to the componentry angle with resect to the vertical will now be made with reference to the embodiment described in the preceding paragraph, wherein further, the planes of the rotor and the crushing chamber housing arm substantially parallel.

This should not be seen to be limiting in any way, as other arrangements, including those described above may be used according to the present invention without departing from the present invention's scope.

The rotor componentry will be referred to hereafter as the crushing chamber, which is intended to encompass the crushing chamber housing, and the rotor.

Reference to the angle from the vertical may be made hereafter with reference to "the angle" for convenience.

The adjustable angle may include angles in all directions about the vertical.

Reference to a rotary impact rock crusher may be made with reference to any crusher whereby rock is introduced to the crusher and has velocity imparted to it by means of a centrifugal rotor, which then sects the rock at speed onto a crushing surface which may be a rock, a rock bed, an anvil or a combination of these.

The crushing chamber may further include an anvil configured so that rocks ejected from the rotor impact on the anvil.

The rock crusher may be configured so that the crushing chamber angle is adjusted to control The fracture mechanisms in the crashing chamber, The rock fracture mechanisms may include shatter/impact, cleavage, attrition, and abrasion (terms defined further).

In some embodiments the control of the fracture mechanisms will be chosen according to the desired rock product output from the crusher.

In all rock crushers, a range of rock grades is always present in the product. A particular fracture mechanism will have a fairly predictable effect on rock and result in a particular rock grade. The choice of fracture mechanisms made by the operator may be made to select and maximise a particular grade of product in the product range.

In some embodiments, the crusher may be configured so that in operation, a rock bed forms on at least a portion of the chamber wall.

In preferred embodiments, the rock bed may form an ever-tightening corner inside a portion of the chamber when the crushing chamber is angled.

The rate at which the ever-tightening corner curves may be controllable by varying the angle of tho rotor, the chamber, or both.

Reference to the ever-tightening corner being formed inside the chamber should be seen to be limiting in any way, as apparatus of the present invention is operable without the ever-tightening corner forming In preferred embodiments, the crusher may be configured so that where a rock swirl develops in the crushing chamber, the ever-tightening corner inside the chamber has a slowing effect on the rock swirl.

This gives several potential advantages. Rock on rock crushing occurs between rocks ejected from the rotor impacting against rocks in the rock swirl. The greatest rock on rock impact occurs when there is the greatest possible differential between the rocks. Generally, the swirls move in the same direction as the ejected rock and therefore the motion of the rock swirl particle reduces the impact fore between the rock swirl particle and the rock ejected from the rotor.

The slowing of the rock swirl by the ever-tightening corner reduces the swirl speed, thereby increasing the speed differential between the rock swirl particles and the rock ejected from the rotor, which improves the rock on rock crushing effect.

The ability to vary the rate to which the ever-tightening corner curves, means that there is greater control over the fracture mechanisms inside the crushing chamber. This is achieved by being able to vary the angle of the crushing chamber componentry.

It should be appreciated that varying the angle of the rotor or crushing chamber alone may also produce significant commercial advantages as above.

There will potentially be a greater crushing effect with reduced distance between the rotor and the anvil face. Therefore, an operator may vary the crushing phenomena inside the crushing chamber by changing the anvil position within the crushing chamber.

According to a further aspect of the present invention there is provided an anvil segment, configured to be used with an impact crusher which includes a crushing chamber housing and a rotor, the anvil characterised in that the position of the anvil in the crusher is adjustable.

Preferably, the adjustable position may be the distance between the rotor on the impact crusher and the anvil.

In other embodiments the adjustable position may refer to adjusting the angle, height, pitch, length of the anvil.

According to a further aspect of the present invention there is provided an anvil segment for use with a rotary impact rock crusher, the anvil characterised in that the anvil is configured to have at least one cavity within the anvil structure.

In some embodiments, there may be a plurality of cavities within the anvil structure.

Reference to there being a plurality of cavities within the anvil within the anvil structure should not be seen to be limiting in any way. The anvil may only have one cavity without departing from the scope of the present invention.

The anvil may be configured so that if the anvil surface wears through a cavity behind the wear point will fill with rock emitted from the rotor.

The anvil may continue to wear around the filled cavity until the impact surface on the anvil is regenerated.

While the anvil is wearing down, the filled cavities provided a sufficient impact surface.

Preferably, the cavity positions may be chosen so that when the anvil wears through, the supplementary rock impact surface on the anvil minimises glancing impacts from rock ejected from the rotor.

In preferred embodiments the anvil may be configured so as to be positioned through a wall of the crushing chamber housing.

Further, the anvil may be accessible and/or adjustable from outside the crushing chamber.

This has an advantage in that the operation of the rock crusher may not need to be ceased in order to adjust the anvils.

Further, in the case where many anvils are used as segments forming a complete or partial anvil ring, each segment may be adjusted on its own as required to maintain the desired fracture mechanisms within the crushing chamber, and hence the desired output rock product.

In some embodiments, the cavity may be rectangular.

In other embodiments the cavity may be square, rounded, or may have some other close-curve cross-sectional or plan configuration without departing from the scope of the present invention.

The cavities within the anvil may be configured to have substantially adjacent vertices.

Reference to the cavities having substantially adjacent vertices should not be seen to be limiting in any way.

In some embodiments, the cavities may be spaced apart from each other depending on the application of the anvil.

Preferably, the anvil may be configured so that when the anvil is first in uses the initial impact surface on the anvil has no cavities.

However this should not be seen to be limiting in any way, as in other embodiments it may be desirable to have cavities on the initial anvil crushing surface.

In some embodiment the cavities may have their longest length tuning the direction of the width of the anvil.

In other embodiments the cavities may have their longest length running the direction of the height of the anvil.

In other embodiments the longest length in the cavity may be in the direction of the length of the anvil.

This configuration would be directed towards providing a continuously wearing impact surface as the anvil surface wears, rather than eventuating a regeneration of the anvil impact surface (see further for explanation of regenerative effect).

In some preferred embodiments the anvil way have a stepped impact surface.

In other embodiments, the anvil may have a flat, or curved impact surface

According to a further aspect of the present invention there is provided a plurality of anvil segments as described above.

The plurality of segments may be configured to form a full or partial anvil ring.

The anvil according to the present invention has a number of advantages.

It is usual for the anvil to wear at the points where rock impact occurs, which formerly meant that the entire anvil needed to be replaced once worn through.

The present invention is configured so that if an anvil crushing surface wears through, the cavity will fill with rock. The anvil will further wear until a new flat face is formed. Thus there is an effective regeneration of the flat face(s) making up the crushing surface of the anvil reconstituting the anvil. This is a large cost saving over prior art anvils which must be replaced when the initial impact surface is worn away.

Thus, this prevents or reduces the degree to which the crusher will lose its specification from a worn anvil and the associated unwanted deflections, in terms of the losing control over the desired fracture mechanisms, and the associated rock product.

Further, when an anvil segment is completely worn the anvil segment needs to be replaced, which improves the cost effectiveness of the anvil. An operator can get the benefit of a fill circular anvil ring, but the cost of maintaining only a short anvil segment The anvil is the most wear-prone component of an anvil crusher, and the expense of maintaining the anvils can mean tat an op ion is not cost-effective. Thus having a longer-lasting anvil, combined with the ability to change each segment individually is of great cost benefit.

Varying the anvil position ray be achieved using a number of means. There may be a sliding mechanism a roller, or some other system allowing the anvil to be moved and held in place.

According to a further aspect of the present invention there is provided a method of controlling the fracture mechanisms in a rotary impact crusher, which includes a crushing chamber housing, and a rotor characterised by the step of altering the relative angles of the crusher componentry.

According to the above method, there may be included tie further step of adjusting the distance between an anvil in the rotary impact crusher and the outlet of the rotor to achieve the desired fracture mechanism.

Preferably, the method herein before described may be achieved using the crusher previously herein described.

Preferably, the above method may be achieved using an anvil as previously herein described.

The fracture mechanisms referred to previously are now discussed.

Impact/shatter may refer to the degree to which a piece of rock will shatter into different pieces. High impact is usually associated with shatter.

The applicant has found that by increasing the anvil penetration or increasing the angle (which exposes more anvil face) of the crushing chamber, an operator may improve the impact/shatter achievable.

Cleavage is term used to refer to a section of rock parting down a line of weakness within the rock and is normally associated with moderate crushing force.

Cleavage upgrades the strength of the rock product as the resultant particles are generally free from lines of weakness, and thus the deleterious rocks removed.

The applicant has found that the present invention can increase the amount of cleavage by increasing the angle of the crushing chamber, which tightens the curve on the ever-tightening corner, slowing the rock swirl improving rock on rock crushing, and also exposing more anvil face.

Attrition refers to the degree to which a larger rock can be broken down to many smaller parts, usually as a result of a long residence time in the crushing chamber.

The applicant has found that decreasing the angle of the crushing chamber and decreasing anvil penetration increase the attrition effect Abrasion is a term used to refer to the effect of a particle tumbling at high speed for a long residence time, wearing away at the particle, resulting in a shaping or rounding effect.

The applicant has found that decreasing the angle of the crushing chamber and decreasing anvil penetration increases the abrasion effect.

Changing the rotor speed can also be used to control the fracture mechanisms inside the chamber.

Preferably, the present invention may include an exit means for the rock product.

Preferably the exit means may include a flexible chute.

Reference to the exit means including a flexible chute should not be seen to be limiting in any way, as rigid chutes may also be used without departing from the scope of the present inventions manufacture or use.

In some embodiments, the present invention may be combined with other plant such as devices that sort the grades of rock produced by the crusher, and may also include machinery for packing and transporting the rock produced from the crusher.

Preferably, the chute may be configured so as to vibrate as a result of the operation of the rock crusher to urge the crushed rock down the chute.

Preferably, the chute may be manufactured from a flexible material.

Preferably, the present invention may include a feed tube configured to introduce rock to the crusher.

The change in angle of the crushing chamber componentry forming the ever tightening configuration has a dramatic effect in terms of the control an operator may have over the output of the rock crusher. This is especially noticeable when used in combination with the different crushing effects using the variable distance anvil.

The effect of the ever-tightening corner slows the rock swirl that occurs in rotary impact rock crushers.

The previous discussion in the prior art section outlines how rock on rock crushing occurs between rocks ejected from the rotor impacting against rocks in the rock swirl. The greatest crushing effect occurs when there is the greatest possible speed differential between the rocks. Generally, the swirls move in the same direction as the rock and therefore the motion of the rock swirl particle reduces the impact force between the rock swirl particle and the rock ejected from the rotor.

The slowing of the rock swirl by the ever-tightening circle reduces the swirl speed, thereby increasing the speed differential between the rock swirl particles and the rock ejected from the rotor, which improves the crushing effect.

The ability to vary the rate to which the ever-tightening corner curves, means that there is greater control over the fracture mechanisms inside the crushing chamber. This is achieved by being able to vary the angle of the crushing chamber componentry.

The angling of the present invention also means that the crushing chamber is at a lower position and will have less head room, and can therefore be more easily combined with existing plant. It can be more easily transported with other machinery as well.

It is preferable to have a double belt drive to impart the angular momentum to the rotor.

Normally a "V" drive is used with two motors and drive belts positioned substantially opposite each other to drive the rotor.

The present invention enables a "V" drive arrangement to be employed whereby the motors and belts are positioned at an acute angle relative to each other to drive the rotor.

The motors can be positioned on the side opposite the side where the rock is ejected from the rock crusher.

This makes the present invention more compatible with supplementary machinery.

The advantages of the present invention result in a device that has a significantly higher control over the fracture mechanisms occurring in the rock crusher, than was previously achievable in the prior art crushers. An operator may choose a particular rock product output one day, and then adjust the settings on the crusher the next time to maximise another grade of rock in the rock product.

The present invention enables the operator to change the settings to dial up a particular rock product.

The present invention also allows the operator to adjust the settings on the rock crusher while it is operating in order to maintain the rock product specification at optimum levels at all times.

BRIEF DESCRIPTION OF DRAWINGS

Further aspects of the present invention will become apparent from the ensuing description which is given by way of example only and with reference to the accompanying drawings in which.

MODES FOR CARRYING OUT THE INVENTION

Figure 1:
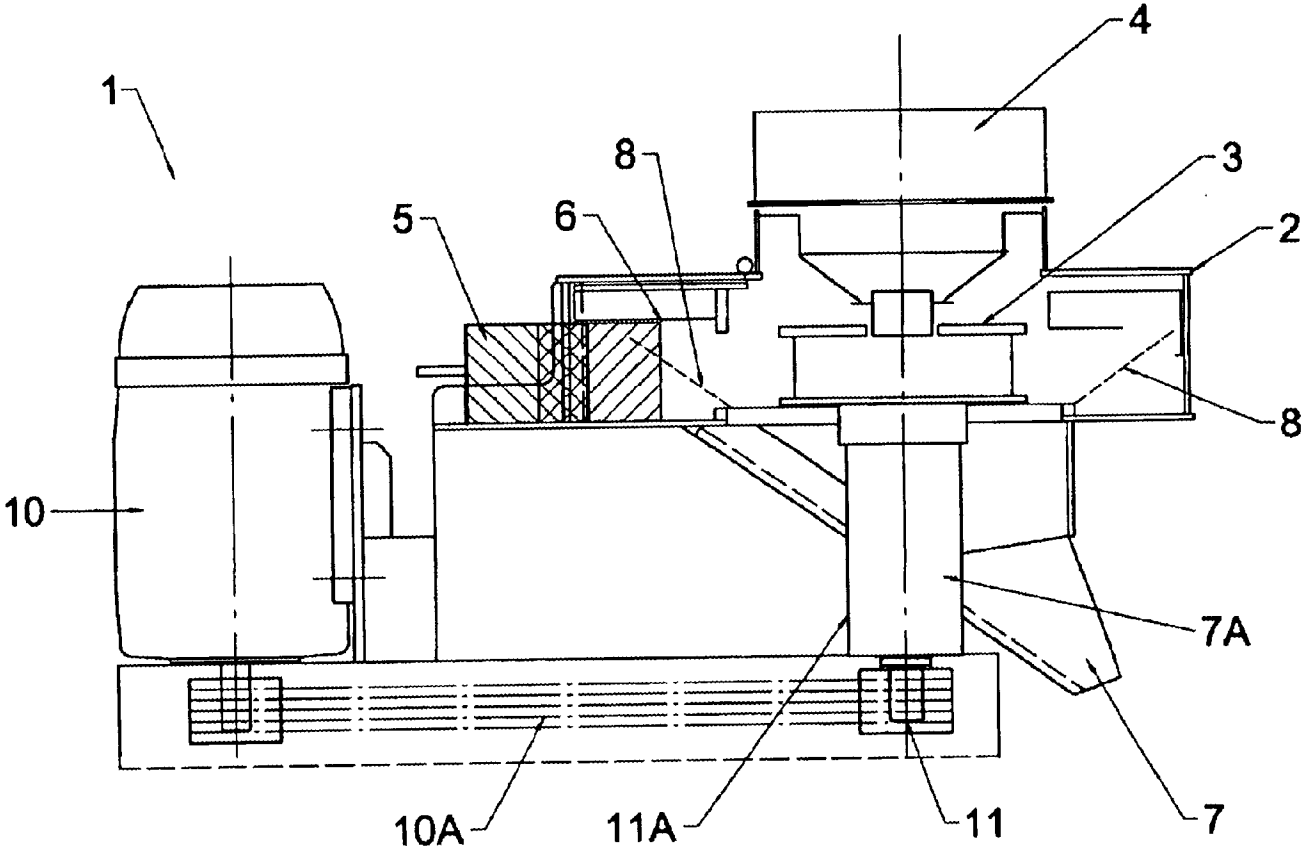
FIG. 1 shows one embodiment of the present invention in a substantially horizontal position.

With reference to FIG. 1 thee is shown one embodiment of the present invention with the crushing chamber components in a substantially horizontal orientation.

The rock Crusher 1 includes a crushing chamber housing 2. The crushing chamber housing houses a rotor 3 into which rock is introduced via feed tube 4. The rotor 3 includes exit openings on its sides, which are not shown. The rotor spins and the rocks are flung outwards from the rotor openings at between 30–90 m/s.

The crushing chamber 2 also includes an anvil 5. The rock impact on the anvil face 6. Most of the rock that shatters as a result of impact will travel down the angled chute 7 for collection.

11A designates a shaft housing which houses the shaft 11. The shaft housing 11A may be circular or rectangular or some other polygonal shape. The configuration of the chute 7 is such that where the plane of the chute 7 intersects the shaft housing 11A at point 7A, the shaft housing passes through the chute 7 at an angle. Where the shaft housing 11A intersects the chute at point 7A there may be sufficient chute width either side of the shaft housing 11A to allow the rock product emitted from the rotor to be transported by the chute 7.

Other shattered rock forms a wall, shown by angle rock wall 8.

Figure 2:
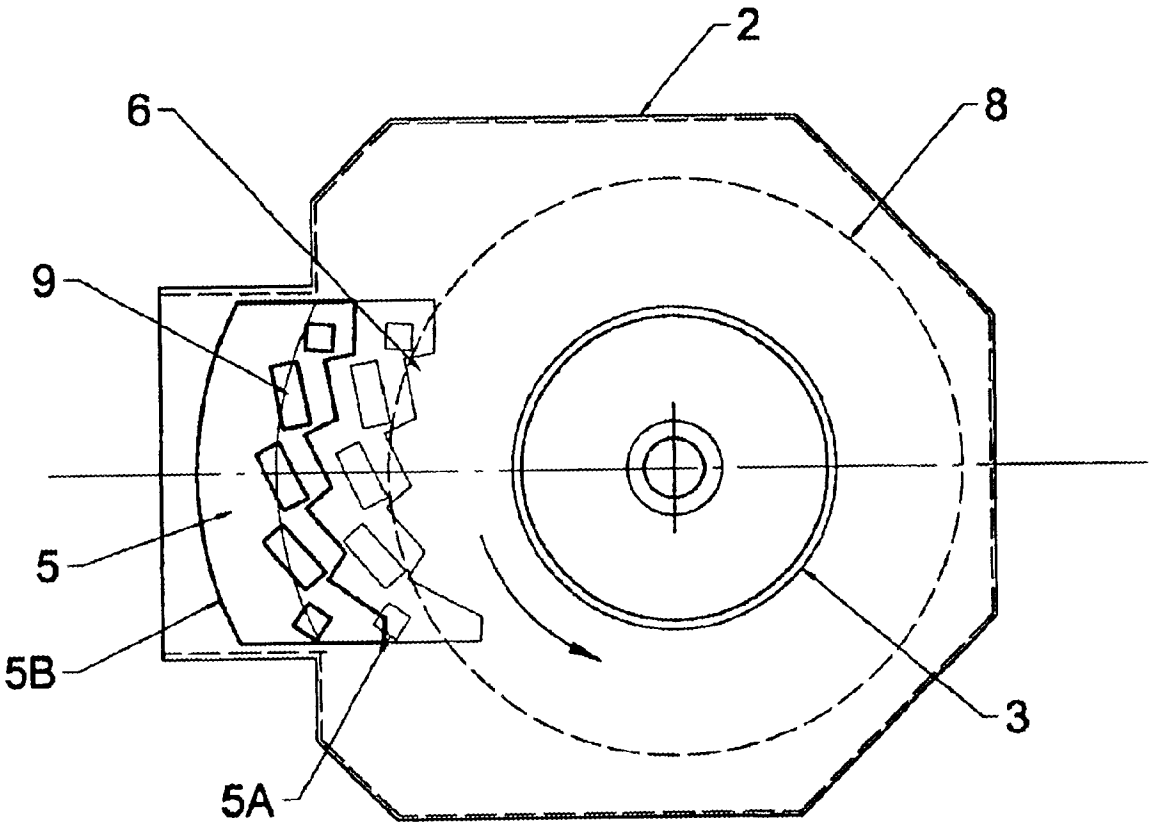
FIG. 2 shows a plan view of the crushing chamber in FIG. 1.

FIG. 2 shows a plan view of the crushing chamber housing 2. The rock wall 8 is substantially equi-distant from the rotor, all the way around the crushing chamber housing 2.

The adjustable anvil 5 is shown in two positions in FIG. 2. The first is shown by the lighter lines 5A and the other position is shown by darker lines 5B. The anvil includes cavities 9. The distance between the anvil end face 6 and the rotor is adjustable.

Figure 3:
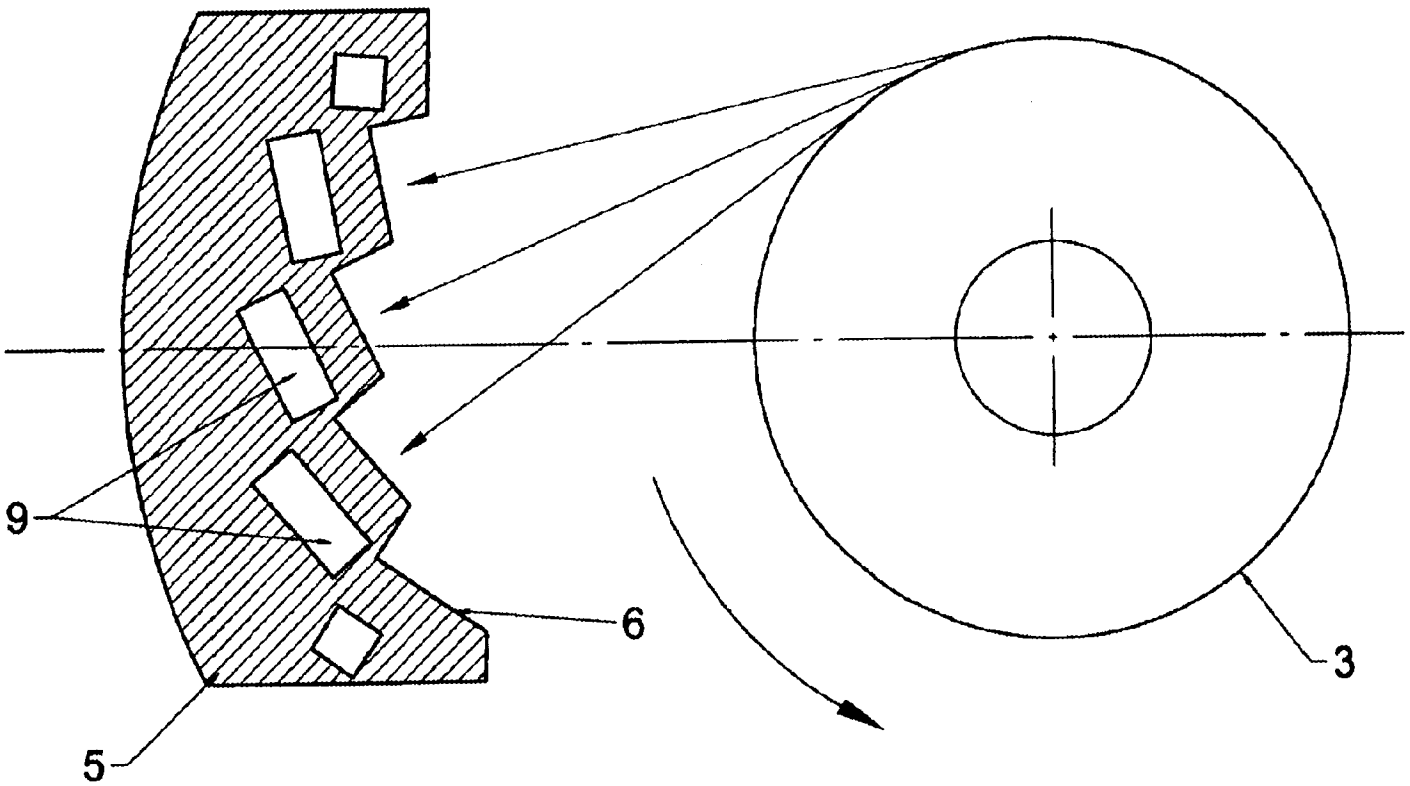
FIG. 3 shows a schematic illustration of the anvil according to the present invention.

The view in FIG. 1 shows the drive mechanism for the rotor 3, being a motor 10, which may be electrical or otherwise, driving a belt 10A which in turn is connected to a shaft 11 whose rotation results in the rotation of the rotor 3. Preferably there may be two drive mechanisms arranged in a "V" arrangement With reference to FIG. 3, there is shown a closer view of the anvil and the rotor. In a preferred embodiment, the anvil face 6 may have a stepped appearance as shown in FIG. 3.

However, this should not be seen to be limiting in any way, as the anvil face may be configured to be substantially smooth, straight curved by the configurations without departing from the scope of the present invention.

The anvil has at least one cavity 9 formed a distance behind the anvil face 6. In preferred embodiments, the cavities 9 may be rectangular. However, reference to rectangular cavities in the anvil should not be seen to be limiting in any way, as other shaped cavities may be formed in the anvil without departing from the scope of the present invention.

For example the cavities 9 may be circular, square, or may have some other polygonal plan or cross sectional shape.

The anvil may be constructed from any single or combination of metals or other substances depending on the durability desired. For example there may be tungsten carbide inserts or other metals used in the anvil construction.

Figure 3A:
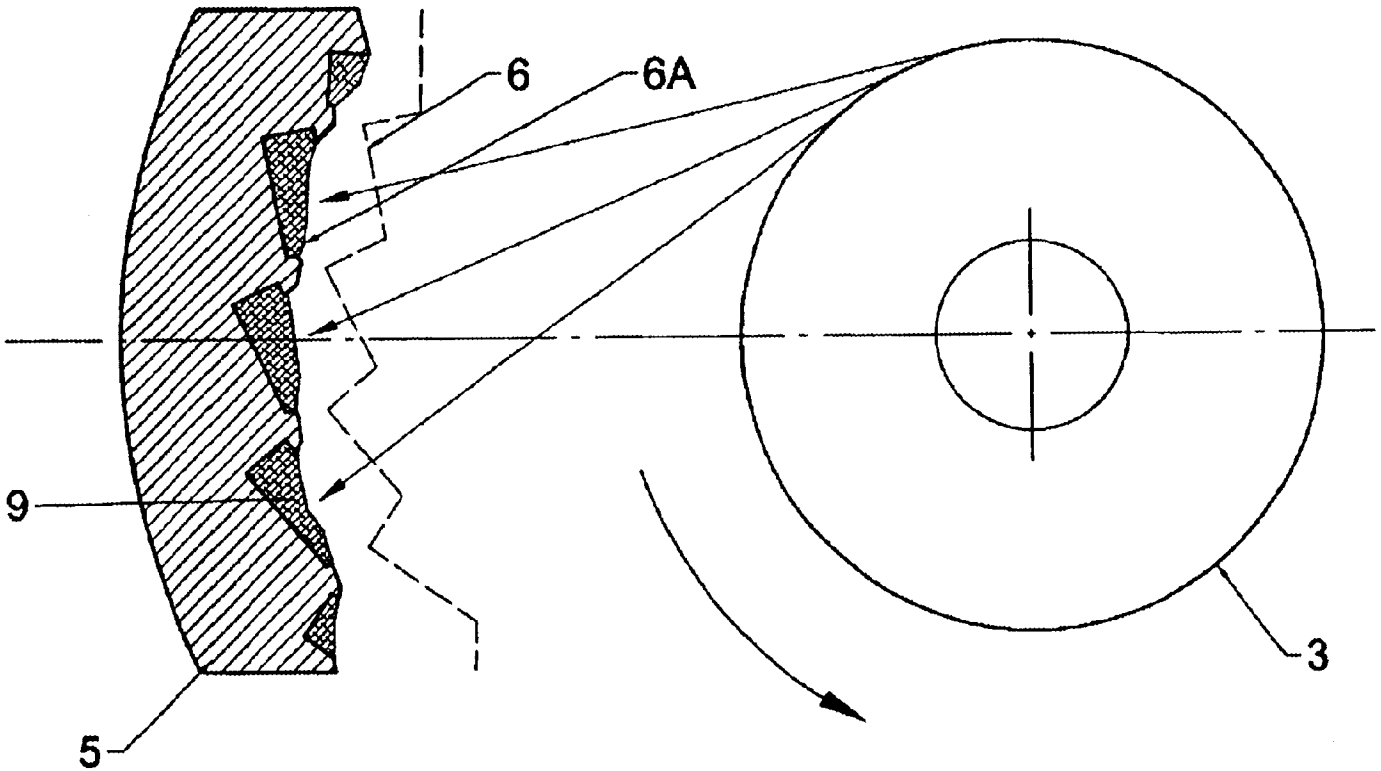
FIG. 3A shows the anvil of FIG. 3 after a period of use.

FIG. 3A shows the initial anvil plate worn down, and a new anvil plate 6A is formed. The anvil plate 6A includes cavities 9 filled with crushed rock.

The rocks exiting the rotor will now impact against the rock that is packed into the cavities 9 and will act as a crushing surface.

The present invention is configured so that if an anvil plate surface 6 wears through, the cavity 9 will fill with rock. As the rest of the anvil either side of the cavity wears, the anvil will continue to provide a satisfactory impact surface. The anvil will finally completely regenerate to a flat surface.

Furthermore, the variable distance between the anvil face 6 and the rotor 3 allows control over the impact force experienced by the rock.

The means for varying the anvil distance may be a sliding mechanism, a roller, or some other track system allowing the anvil to be moved and held in place, although these are not detailed in the figures.

Figure 4:
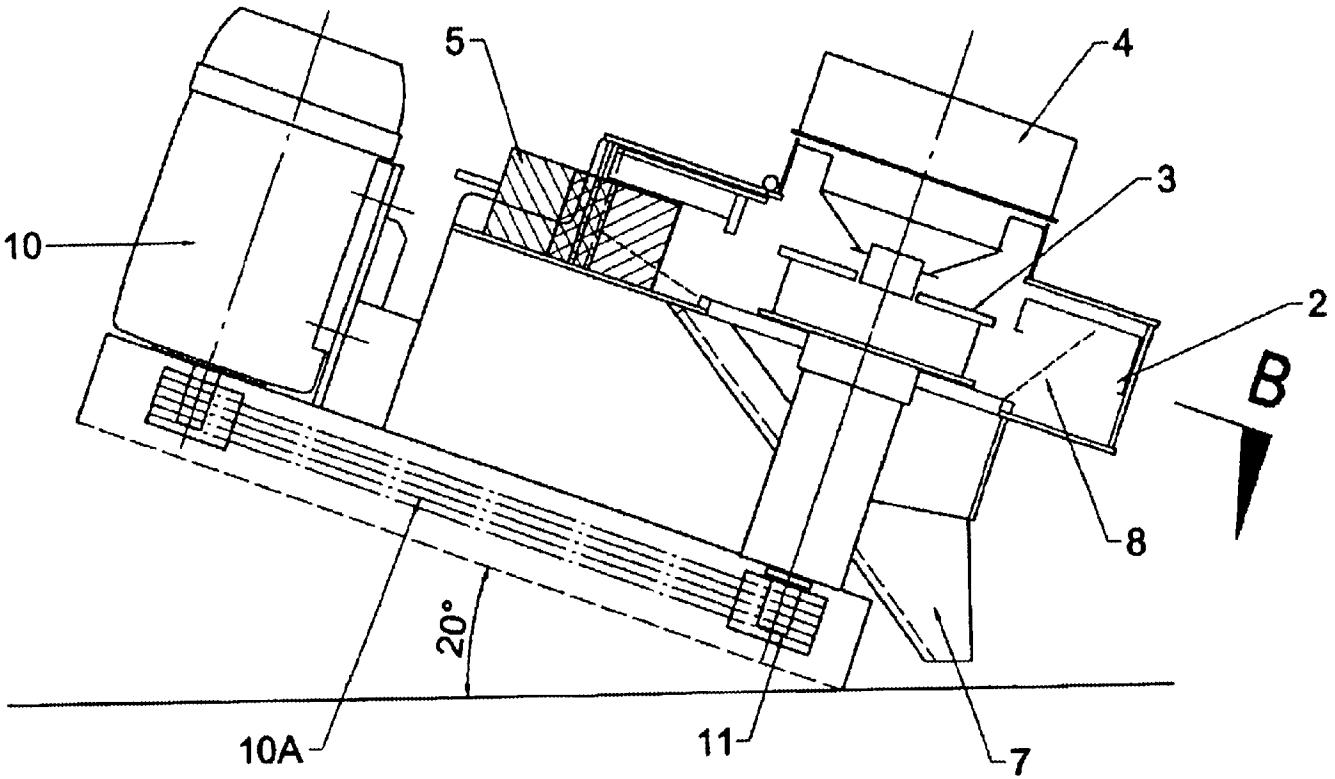
FIG. 4 shows the present invention in a substantially angled orientation.
Figure 5:
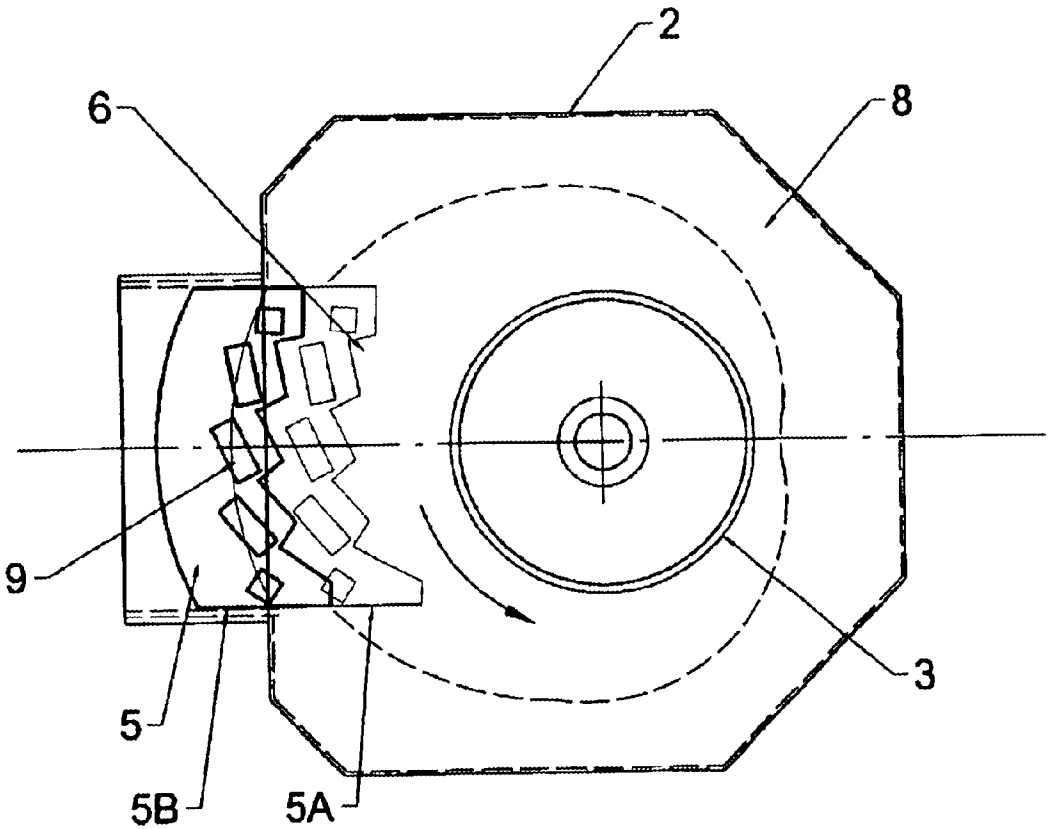
FIG. 5 shows a plan view of the crushing chamber shown in FIG. 4.

Now referring to FIGS. 4 and 5, the present invention is shown with the crushing chamber componentry at an angled position.

The most apparent changes relate to the rock build-up 8, which as a result of the continuous action of gravity will form in substantially the same angle as when the chamber 2 is in the horizontal position However, because the chamber componentry is now angled, the relative steepness of the rock wall relative to the rock chamber is increase on the side farthest from the anvil 5, and decreased on the side closest to the anvil 5.

FIG. 5 demonstrates the change in appearance of the rock wall from a plan view. It can be seen that the rock wall forms an ever tightening corner behind the rotor on the side opposite the anvil. As the angle increases, the curve on the corner will tighten further, giving control over the speed of the rock swirl.

The combination of control using the anvil distance variation in combination with the angle variation gives an operator a significantly improved degree of control over the type of rock product produced by the present invention.

It should be appreciated that varying the angle of the rotor 3 or crushing chamber 2 alone may also produce significant commercial advantages as above.

The angling of the present invention means that it takes up less head room, and can therefore be more easily combined with existing plant It can be more easily transported with other machinery as well.

It can be seem that the combination of improved control over the above characteristics provide a machine that has a significant commercial advantage over the prior art As an illustration of the potential advantages of the present invention, the Applicant has compiled the following table, subjectively comparing the performance of the present invention with the prior art.

The points given are subjective with the greater number of points, the better.

TABLE 1

| | Possible Points | Standard Cone | Short/ Fine Cone | Rock on Rock VSI | Anvil VSI | Hammermill/ Impactor | ASI |
|---|---|---|---|---|---|---|---|
| Performance | | | | | | | |
| Feed Size | 4 | 4 | 1 | 2 | 4 | 3 | 3 |
| Dust Production | 4 | 1 | 2 | 3 | 3 | 2 | 4 |
| Chip Production | 4 | 3 | 2 | 3 | 4 | 2 | 4 |
| Product Shape | 4 | 2 | 2 | 4 | 2 | 3 | 4 |
| Product Control | 4 | 2 | 2 | 2 | 2 | 2 | 4 |
| Cost | | | | | | | |
| Wear Rate | 6 | 6 | 5 | 6 | 1 | 1 | 3 |
| Power Consumption | 3 | 3 | 3 | 1 | 2 | 2 | 2 |
| Capital Cost | 8 | 1 | 2 | 4 | 2 | 6 | 6 |
| Installation | | | | | | | |
| Height | 2 | 2 | 2 | 1 | 1 | 2 | 2 |
| Weight | 2 | 1 | 1 | 2 | 1 | 2 | 2 |
| TOTAL | 41 | 25 | 22 | 28 | 22 | 25 | 34 |

Aspects of the present invention have been described by way of example only and it should be appreciated that modifications and additions may be made thereto without departing from the scope thereof as defined in the appended claims.

What I claim is:

1. A rotary impact rock crusher for crushing rocks, comprising:

a crushing chamber housing; and a rotor positioned in the crushing chamber housing, the rotor being configured to receive the rocks thereinto and to eject the rocks outwardly therefrom, wherein an angle of the rotor with respect to a vertical direction is adjustable, and wherein the rotor and the crushing chamber housing are at a fixed position relative to each other so that the angle of the rotor and an angle of the crushing chamber housing with respect to the vertical direction are adjustable together.

2. A rock crusher as claimed in claim 1, wherein the crushing chamber housing includes an anvil for the rocks ejected from the rotor to impact on.

3. A rock crusher as claimed in claim 1, wherein the rock crusher is configured such that, in operation, a rock wall is formed in at least part of an interior of the crushing chamber housing.

4. A rock crusher as claimed in claim 3, wherein the rock wall forms an ever-tightening corner when at least one of rock crusher component angles is adjusted from the vertical direction.

5. A rock crusher as claimed in claim 1, wherein the rotor includes a drive shaft configured such that an angle of the drive shaft with respect to the vertical direction is variable independently of at least one other component in the rock crusher.

6. A rock crusher as claimed in claim 1, further comprising an anvil, a position of the anvil being adjustable in the rock crusher.

7. A rock crusher as claimed in claim 6, wherein the anvil has a stepped face.

8. A rock crusher as claimed in claim 7, wherein the anvil includes at least one cavity associated with the stepped face.

9. A rock crusher as claimed in claim 6, wherein the anvil is located through an aperture in a crushing chamber wall.

10. A rock crusher as claimed in claim 9, wherein the anvil is adjustable by altering the position of the anvil through the aperture in the crushing chamber wall.

11. A rock crusher as claimed in claim 6, wherein the anvil is adjustable from outside of the crushing chamber housing of the rock crusher.

12. A rock crusher as maimed in claim 6, wherein the adjustable position of the anvil is a distance between the rotor and the anvil.

13. A rock crusher as claimed in claim 6, wherein the anvil includes at least one cavity positioned therewithin.

14. A rock crusher as claimed in claim 13, wherein the anvil is configured such that, if an anvil surface wears through, the at least one cavity will be filled with at least a portion of the rocks ejected from the rotor.

15. A rock crusher as claimed in claim 14, wherein further wearing of the anvil will regenerate an anvil impact surface.

16. A rock crusher as claimed in claim 6, wherein the anvil includes a plurality of cavities therewithin.

17. A rock crusher as claimed in claim 16, wherein the cavities have substantially adjacent vertices.

18. A rock crusher as claimed in claim 1, wherein the crushing chamber housing includes a plurality of anvils arranged to operate in combination with the rotor.

19. A rock crusher as claimed in claim 1, further comprising an exit means for crushed rocks, the exit means projecting to one side of the rock crusher.

20. A rock crusher as claimed in claim 19, further comprising a shaft housing for a shaft driving the rotor in the rock crusher, the exit means surrounding the shaft housing such that a plane of the exit means intersects with the shaft housing at an acute angle.

21. A rock crusher as claimed in any one of claim 19 or 20, wherein the exit means is a chute and the chute is configured to vibrate as a result of operation of the rock crusher to urge the crushed rocks down the chute.

22. A rock crusher as claimed in claim 21, wherein the chute is manufactured from rubber or plastic material.

23. A rotary impact rock crusher for crushing rocks, comprising:

a crushing chamber housing; and a rotor positioned in the crushing chamber housing, the rotor being configured to receive the rocks thereinto and to elect the rocks outwardly therefrom, wherein an angle of the rotor with respect to a vertical direction is adjustable, and wherein the angle of the rotor and an angle of the crushing chamber housing with respect to the vertical direction are adjustable independently of other crusher componentry.

24. A rock crusher as claimed in any of claim 1 or 23, wherein the angle of the crushing chamber housing with respect to the vertical direction is adjustable to control rock fracture mechanisms in the rock crusher.

* * * * *

UNITED STATES PATENT AND TRADEMARK OFFICE

CERTIFICATE OF CORRECTION

PATENT NO. : 6,783,092 B1
DATED : August 31, 2004
INVENTOR(S) : Angus Peter Robson It is certified that error appears in the above-identified patent and that said Letters Patent is hereby corrected as shown below:

Title page,
Item [57], ABSTRACT,
Line 5, after "position", insert -- is --.

Column 11,
Line 35, "maimed" should read -- claimed --.

Column 12,
Line 19, "claim" should read -- claims --.
Line 24, "plastic" should read -- plastic-based --.
Line 31, "elect" should read -- eject --.
Line 38, "claim" should read -- claims --.

Signed and Sealed this

Fourteenth Day of December, 2004

JON W. DUDAS
*Director of the United States Patent and Trademark Office*